US007623986B2

(12) United States Patent
Miller

(10) Patent No.: US 7,623,986 B2
(45) **Date of Patent: *Nov. 24, 2009**

(54) SYSTEM AND METHOD FOR POWER PUMP PERFORMANCE MONITORING AND ANALYSIS

(76) Inventor: J. Davis Miller, 6 Horizon Point, Frisco, TX (US) 75034-6840

( * ) Notice: Subject to any disclaimer, the term of this patent is extended or adjusted under 35 U.S.C. 154(b) by 440 days.

This patent is subject to a terminal disclaimer.

(21) Appl. No.: 11/105,709

(22) Filed: Apr. 14, 2005

(65) Prior Publication Data

US 2005/0180868 A1 Aug. 18, 2005

Related U.S. Application Data

(63) Continuation of application No. 10/373,266, filed on Feb. 21, 2003, now Pat. No. 6,882,960.

(51) Int. Cl.
*G06F 9/06* (2006.01)

(52) U.S. Cl. ..... 702/182; 702/177; 702/179; 702/183

(58) Field of Classification Search ..... 702/74, 702/91, 104, 183, 188, 189, 182, 177, 179; 175/24; 417/43; 700/90
See application file for complete search history.

(56) References Cited

U.S. PATENT DOCUMENTS 5,063,775 A * 11/1991 Walker et al. ..... 73/152.31
5,421,208 A 6/1995 Packard et al.
5,678,521 A 10/1997 Thompson et al.
6,206,108 B1 * 3/2001 MacDonald et al. ..... 175/24
6,208,497 B1 3/2001 Seale et al.
6,582,204 B2 * 6/2003 Gray, Jr. ..... 417/364
6,882,960 B2 * 4/2005 Miller ..... 702/182

* cited by examiner

*Primary Examiner*—Eliseo Ramos Feliciano
*Assistant Examiner*—Felix E Suarez
(74) *Attorney, Agent, or Firm*—Gardere Wynne Sewell LLP

(57) ABSTRACT

A power pump performance analysis system includes a signal processor connected to pressure sensors for sensing pressures in the cylinder chambers and inlet and discharge piping of a single or multi-cylinder pump. Pump speed and piston position are determined by a crankshaft position sensor. Pump vibration, fluid temperatures, and power input may also be measured by sensors connected to the processor. Performance analyses, including determination of pump volumetric efficiency, mechanical efficiency, suction and discharge valve sealing delay, valve and piston seal leakage, flow induced pressure variations, acceleration induced pressure detection, hydraulic resonance detection and pulsation dampener performance may be measured and selected parameters displayed on a visual display connected to the processor directly or via a network.

11 Claims, 13 Drawing Sheets

SYSTEM AND METHOD FOR POWER PUMP PERFORMANCE MONITORING AND ANALYSIS

This application is a continuation of application Ser. No. 10/373,266 filed Feb. 21, 2003, now U.S. Pat. No. 6,882,960, issued on Apr. 19, 2005.

BACKGROUND

Reciprocating piston positive displacement pumps, often called power pumps, are ubiquitous, highly developed machines used in myriad applications. However, a reciprocating piston power pump is inherently a hydraulic pressure pulse generator producing hydraulic imposed forces that cause wear and tear on various pump components, including but not limited to piping connected to the pump, the pump cylinder block or so-called fluid end, inlet and discharge valves, including actuating springs, and seal components, including piston or plunger seals.

There has been a longstanding need to provide improved performance analysis for reciprocating piston power pumps, in particular, to determine if deteriorations in pump performance are occurring, to analyze the source of decreased performance and to further provide an analysis which may be used to schedule replacing certain so-called expendable parts of the pump prior to possible catastrophic failure.

Pump operating characteristics can have a deleterious affect on pump performance. For example, delayed valve closing and sealing can result in loss of volumetric efficiency, and indicate a need for increased pulsation dampener sizing requirements. Factors affecting pump valve performance include fluid properties, valve spring design and fatigue life, valve design and the design of the cylinder or fluid end housing. For example, delayed valve response also causes a higher pump chamber pressure than normal. Higher pump chamber pressures may cause overloads on pump mechanical components, including the pump crankshaft or eccentric and its bearings, speed reduction gearing, the pump drive shaft and the pump prime mover. Moreover, increased fluid acceleration induced pressure "spikes" in the pump suction and discharge flowstreams can be deleterious. Fluid properties are also subject to analysis to determine compressibility, the existence of entrained gases in the pump fluid stream, susceptibility to cavitation and the affect of pump cylinder or fluid end design on fluid properties and vice versa.

Still further, piston or plunger seal or packing leaking can result in increased delay of pump discharge valve opening with increased hydraulic flow and acceleration induced hydraulic forces imposed on the pump and its discharge piping. Moreover, proper sizing and setup of pulsation control equipment is important to the efficiency and long life of a pump system. Pulsation control equipment location and type can also affect pump performance as well as the piping system connected to the pump.

Accordingly, as mentioned above, there has been a continuing need to provide a system and method for pump performance analysis which is convenient to use, may be easily installed on existing working pump systems, may provide for determination of what factors are affecting pump performance and may identify what pump components may be in a state of deterioration from design or ideal operating conditions. It is to these ends that the present invention has been developed.

SUMMARY OF THE INVENTION

The present invention provides an improved system for monitoring and analyzing performance parameters of reciprocating piston or so called power pumps and associated piping systems.

The present invention also provides an improved method for analyzing power pump performance.

In accordance with one aspect of the present invention, a system is provided which includes a plurality of sensors which may be conveniently connected to a reciprocating piston power pump for measuring various performance parameters, said sensors being connected to a digital signal processor which processes signal received from the sensors and provides for transmission of data and certain graphic displays which indicate the status of various pump components and their performance. The system is conveniently mounted on existing pump installations and may include pressure sensors for measuring (a) fluid pressures in piping upstream and downstream of the pump, (b) any or all cylinder chamber pressures, (c) the temperature of the fluid being pumped, (d) the temperature of the lubricating oil of the mechanical drive or so-called power end of the pump, (e) vibration of the pump and/or connected piping, (f) power input to the pump power end, and (g) pump crankshaft position. Signals from sensors measuring the aforementioned parameters are input to a commercially available digital signal processor, which signals are then analyzed by a computer program and may be output to a receiver, such as a computer, either directly or via a network, such as the Internet.

In accordance with a further aspect of the present invention, the pump performance analysis system provides unique displays showing pump operating parameters including peak-to-peak pressures, pump flow rate, volumetric and mechanical efficiency, valve operating characteristics and piston/plunger seal operating characteristics. Graphical displays of various other parameters may also be provided.

Still further, in accordance with the invention, a system is provided for generating a graphical display of pump discharge or pump chamber pressures as a function of piston or plunger position in the cylinder chamber, and providing data indicating valve closing and opening characteristics. Graphical displays of pump speed versus discharge pressure variation and valve sealing delays are provided. Still further, pump discharge pressure versus crankshaft rotational position and pressure spikes or so-called frequency response are graphically displayed using the system of the invention. The system further provides graphical displays of pump speed versus discharge piping pressure, pump intake (suction) manifold pressure and peak-to-peak pressures versus pump speed, the last mentioned displays being three dimensional or simulated three dimensional displays.

The performance analysis system of the present invention further includes an easily utilized sensor for determining the positions of the pump plungers or pistons for one complete revolution of the pump eccentric or crankshaft. An optical switch including a beam interruption, mountable on a pump crosshead extension part, for example, is easily provided, requires no intrusion into the power end of the pump, and is operable to provide pump piston or plunger position determination and pump speed.

Still further, the system of the invention includes the use of easily mountable pump chamber pressure sensors to detect chamber pressure, valve seal delays, fluid compression delays, piston or plunger packing and seal operation, suction acceleration head loss response, pump delta volume factor required to predict pulsation control equipment performance, and maximum and minimum pump chamber pressures. Pump delta volume factor is the volume of fluid a pulsation dampener must take in and discharge to provide continuous non-varying fluid flow divided by total pump chamber piston displacement.

The method of the present invention utilizes the system of the invention described above to determine pump suction and discharge valve performance, compression delays as a function of pump chamber size, fluid compressibility and fluid decompression together with pump chamber volumetric efficiency.

The method of the invention further measures pressure variations during fluid compression to indicate the condition of piston or plunger packing or seals, suction and discharge valve leak rates, pump suction line acceleration head, fluid cavitation detection and valve sticking.

Still further, the method of the invention also provides for sensing fluid pressures to determine flow induced and acceleration induced pressure variations, fluid hydraulic resonance detection, pneumatic pulsation control equipment performance, volumetric efficiency, flow rate, net positive suction head, mechanical efficiency, component work history and life cycle analysis.

Those skilled in the art will further appreciate the above-mentioned advantages and superior features of the system and method of the invention, together with other important aspects thereof, upon reading the detailed description which follows in conjunction with the drawing.

DETAILED DESCRIPTION OF THE PREFERRED EMBODIMENTS

Figure 1:
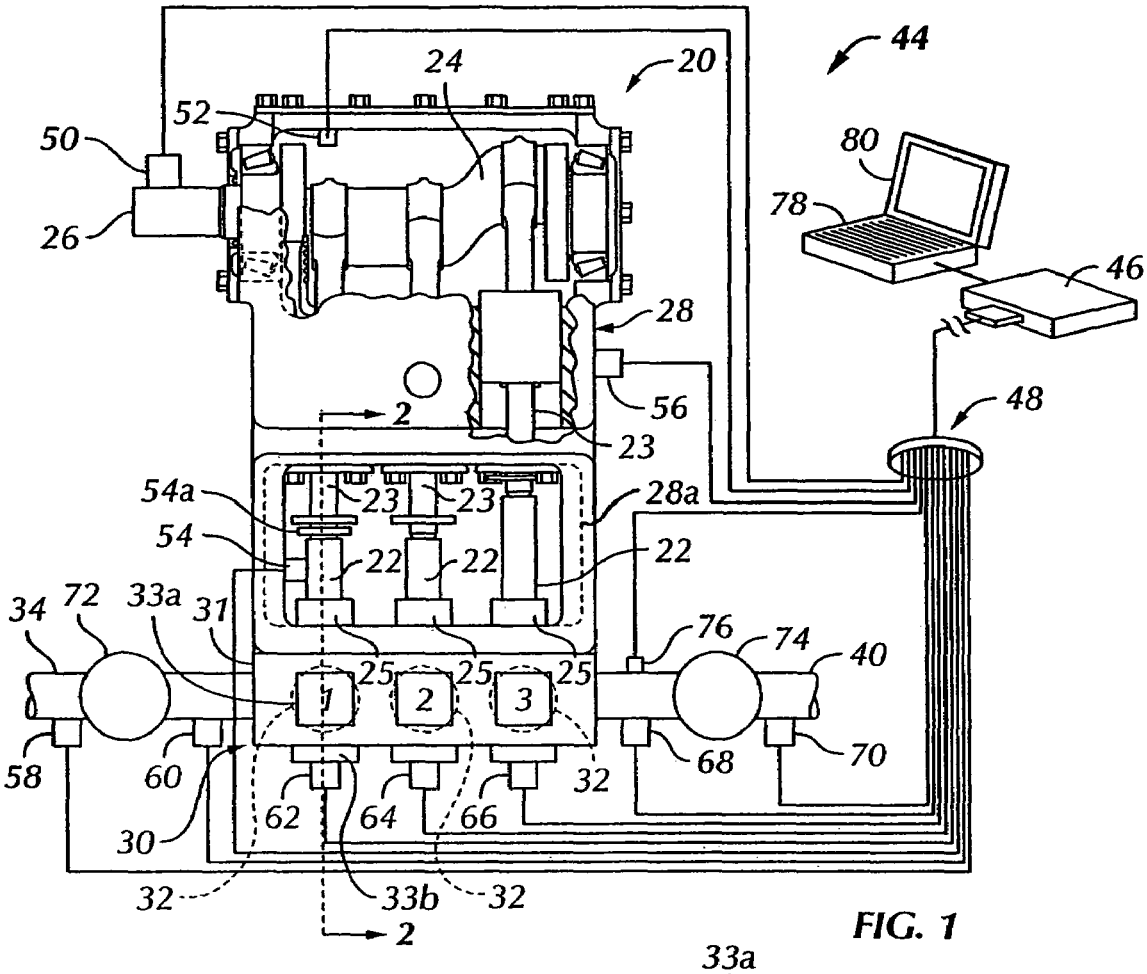
FIG. 1 is a top plan view in somewhat schematic form showing a reciprocating plunger or piston power pump connected to the performance analysis system of the present invention.

In the description which follows like elements are marked throughout the specification and drawing with the same reference numerals, respectively. Certain features may be shown in somewhat schematic form in the interest of clarity and conciseness.

Referring to FIG. 1, there is illustrated in somewhat schematic form, a reciprocating plunger or piston power pump, generally designated by the numeral 20. The pump 20 may be one of a type well-known and commercially available and is exemplary in that the pump shown is a so-called triplex plunger pump, that is the pump is configured to reciprocate three spaced apart plungers or pistons 22, which are connected by suitable connecting rod and crosshead mechanisms, as shown, to a rotatable crankshaft or eccentric 24. Crankshaft or eccentric 24 includes a rotatable input shaft portion 26 adapted to be operably connected to a suitable prime mover, not shown, such as an internal combustion engine or electric motor, for example. Crankshaft 24 is mounted in a suitable, so-called power end housing 28 which is connected to a fluid end structure 30 configured to have three separate pumping chambers exposed to their respective plungers or pistons 22, one chamber shown in FIG. 2, and designated by numeral 32.

Figure 2:
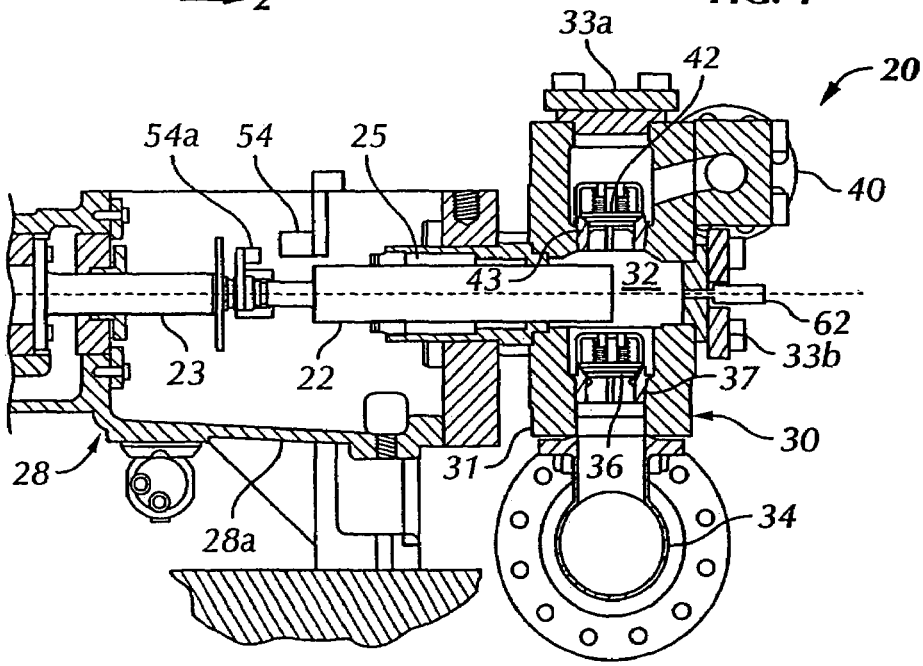
FIG. 2 is a longitudinal central section view taken generally along line 2-2 of FIG. 1.

FIG. 2 is a more scale-like drawing of the fluid end 30 which, again, is that of a typical multi-cylinder power pump and the drawing figure is taken through a typical one of plural pumping chambers 32, one being provided for each plunger or piston 22, the term piston being used hereinafter. FIG. 2 illustrates fluid end 30 comprising a housing 31 having the aforementioned plural cavities or chambers 32, one shown, for receiving fluid from an inlet manifold 34 by way of conventional poppet type inlet or suction valves 36, one shown. Piston 22 projects at one end into chamber 32 and is connected to a suitable crosshead mechanism, including a crosshead extension member 23. Crosshead member 23 is operably connected to the crankshaft or eccentric 24 in a known manner. Piston 22 also projects through a conventional packing or piston seal 25, FIG. 2. Each chamber for each of the pistons 22 is configured generally like the chamber 32 shown in FIG. 2 and is operably connected to a discharge piping manifold 40 by way of a suitable discharge valve 42, as shown by example. The valves 36 and 42 are of conventional design and are typically spring biased to their closed positions. Valve 36 and 42 each also include or are associated with removable valve seat members 37 and 43, respectively. Each of valves 36 and 42 may also have a seal member formed thereon engageable with the associated valve seat to provide fluid sealing when the valves are in their respective closed and seat engaging positions.

The fluid end 30 shown in FIG. 2 is exemplary, shows one of the three cylinder chambers 32 provided for the pump 20, each of the cylinder chambers for the pump 20 being substantially like the portion of the fluid end illustrated. Those skilled in the art will recognize that the present invention may be utilized with a wide variety of single and multi-cylinder reciprocating piston power pumps as well as possibly other types of positive displacement pumps. However, the system and method of the invention are particularly useful for analysis of reciprocating piston or plunger type pumps. Moreover, the number of cylinders of such pumps may vary substantially between a single cylinder and essentially any number of cylinders or separate pumping chambers and the illustration of a so called triplex or three cylinder pump is exemplary.

Referring further to FIG. 1, the performance analysis system of the invention is illustrated and generally designated by the numeral 44 and is characterized, in part, by a digital signal processor 46 which is operably connected to a plurality of sensors via suitable conductor means 48. The processor 46 may be of a type commercially available such as an Intel Pentium 4 capable of high speed data acquisition using Microsoft WINDOWS XP type operating software, and may include wireless remote and other control options associated therewith. The processor 46 is operable to receive signals from a power input sensor 50 which may comprise a torque meter or other type of power input sensor. Power end crankcase oil temperature may be measured by a sensor 52. Crankshaft and piston position may be measured by a non-intrusive sensor 54 including a beam interrupter 54*a*, FIG. 2, mountable on a pump crosshead extension 23, for example, for interrupting a light beam provided by a suitable light source or optical switch. Sensor 54 may be of a type commercially available such as a model EE-SX872 manufactured by Omron Corp. and may include a magnetic base for temporary mounting on part of power end frame member 28*a*. Beam interrupter 54*a* may comprise a flag mounted on a band clamp attachable to crosshead extension 23 or piston 22. Alternatively, other types of position sensors may be mounted so as to detect crankshaft or eccentric position.

Referring further to FIG. 1 a vibration sensor 56 may be mounted on power end 28 or on the discharge piping or manifold 40 for sensing vibrations generated by the pump 20. Suitable pressure sensors 58, 60, 62, 64, 66, 68 and 70 are adapted to sense pressures as follows. Pressure sensors 58 and 60 sense pressure in inlet piping and manifold 34 upstream and downstream of a pressure pulsation dampener or stabilizer 72, if such is used in a pump being analysed. Pressure sensors 62, 64 and 66 sense pressures in the pumping chambers of the respective plungers or pistons 22 as shown by way of example in FIG. 2 for chamber 32 associated with pressure sensor 62. Pressure sensors 68 and 70 sense pressures upstream and downstream of a discharge pulsation dampener 74. Still further, a fluid temperature sensor 76 may be mounted on discharge manifold or piping 40 to sense the discharge temperature of the working fluid. Fluid temperature may also be sensed at the inlet or suction manifold 34.

Pump performance analysis using the system 44 may require all or part of the sensors described above, as those skilled in the art will appreciate from the description which follows. Processor 46 may be connected to a terminal or further processor 78, FIG. 1, including a display unit or monitor 80. Still further, processor 46 may be connected to a signal transmitting network, such as the Internet, or a local network.

Figure 3:
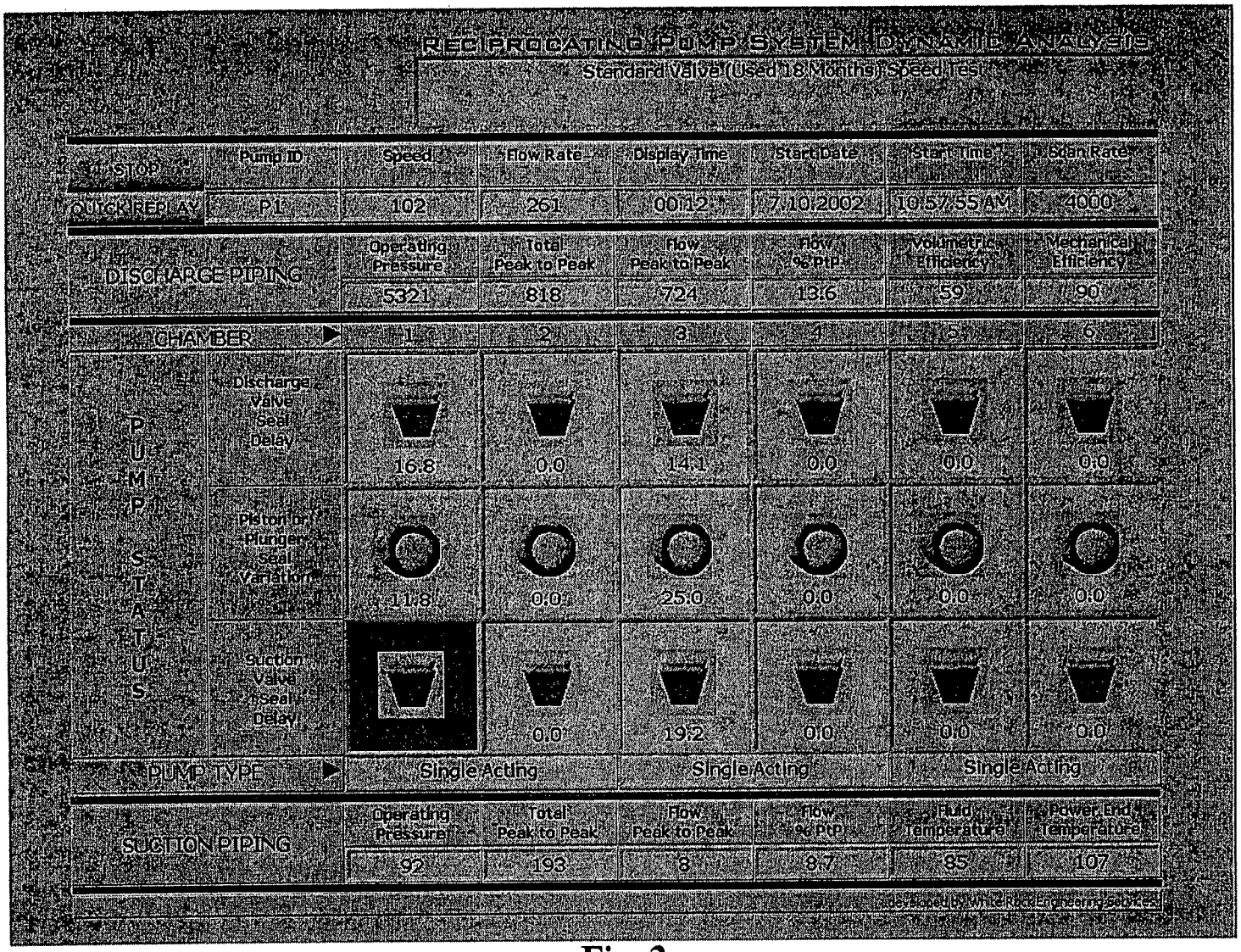
FIG. 3 is a graphic display provided by the system of the invention illustrating valve and pump plunger seal characteristics.

System 44 is adapted to provide a wide array of graphic displays and data associated with the performance of a power pump, such as the pump 20 on a real time or replay basis. Referring to FIG. 3, by way of example, there is shown a reproduction of a graphic display which may be presented on monitor 80 during operation of the system 44 for a triplex, single acting, power pump, such as the pump 20. Viewing FIG. 3, it will be noted that a substantial amount of information is available including pump identification (Pump ID) crankshaft speed, fluid flow rate, time lapse since the beginning of the display, starting date and starting time and scan rate. The display according to FIG. 3 displays discharge piping operating pressure, peak-to-peak pressures, fluid flow rate induced peak-to-peak pressure, fluid flow induced peak-to-peak pressure as a percentage of average operating pressure, pump volumetric efficiency and pump mechanical efficiency. The display of FIG. 3 also indicates discharge valve seal delay in degrees of rotation of the crankshaft 24 from a so called piston zero or top dead center (maximum displacement) starting point with respect to the respective cylinder chambers of the pump 20, as well as piston seal pressure variation during fluid compression and suction valve seal delay in degrees of rotation of the crankshaft or eccentric from the top dead center position of the respective cylinder chambers. Still further, as indicated in FIG. 3, the pump type is displayed as well as suction piping pressures, as indicated.

The parameters displayed in FIG. 3 are determined by the system of the invention which utilizes the sensor 54 and the pressure sensors 62, 64 and 66, and at least the pressure sensors 60 and 68. By rotating the crankshaft 24 to a point wherein the piston 22 in cylinder no. 1 is at top dead center, this position of the crankshaft may be chosen as being at a rotation angle of zero degrees. Beam interrupter 54*a* may be mounted on the crosshead extension 23 for cylinder no. 1 of the pump 20 in a selected position such that, as the plunger 22 for cylinder no. 1 reaches top dead center, the light beam of the sensor 54 is interrupted. Typically, a square wave pulse is generated as the beam of the sensor 54 is interrupted for a finite amount of travel of the piston or plunger for cylinder no. 1. For example, two degrees of rotation of crankshaft 24 before top dead center may be selected as the point in which the beam is interrupted and remains interrupted for a total of four degrees to six degrees of crankshaft rotation. Plunger or piston top dead center position is then determined to be zero at two or three degrees of rotation of the crankshaft 24 from the point at which the beam of sensor 54 is first interrupted and this angularity may be incorporated in software when determining the amount of rotation of the crankshaft 24 that occurs with respect to other events that are sensed by the system 44. The positions of sensor 54 and beam interrupter 54*a* as shown in FIGS. 1 and 2 are not intended to be to scale and other positions may be determined depending on the pump mechanical configuration.

Accordingly, the time from generation of a square wave pulse signal, which begins with the leading edge of the pulse, to when the next square wave pulse signal is generated determines the pump cycle in terms of time and rotation which is three hundred sixty degrees of crankshaft rotation, of the crankshaft 24 and during which all three pistons or plungers 22 move through a full cycle from top dead center to bottom dead center and back to top dead center. Piston top dead center position is being measured with sensor 54, 54*a* and is expressed, for purposes of the data obtained and as shown in the displays of the drawing figures, and otherwise, in terms of crankshaft angle of rotation with respect to piston top dead center. Pump suction stroke timing for each cylinder chamber 32 is represented by one half of a complete cycle which is represented by phase angle of from 0° to 180.0° of rotation. Discharge stroke timing is represented by the second half of the stroke for crankshaft rotation from 180.0° to 360°. Still further, pump speed is determined by the inverse of pump cycle time, that is the time elapsed between interruptions of the beam of the sensor 54.

The respective pressure sensors 62, 64 and 66 sense pressure in the respective pump chambers 32 associated with each of the pistons 22 and pressure signals are transmitted to the processor 46. These pressure signals may indicate when valves 36 and 42 are opening and closing, respectively. For example, if the pressure sensed in a pump chamber 32 does not rise essentially instantly, after the piston 22 for that chamber passes bottom dead center by 0° to 10° of crankshaft rotation, then it is indicated that the inlet or suction valve is delayed in closing or is leaking. In FIG. 3, for example, the inlet or suction valve for chamber no. 1 is delayed for as much as 21.4° of rotation past bottom dead center, as indicated. Thus, the fluid inlet valve 36 for that chamber is not closing and completely sealing properly. By the same token, once the piston 22 for cylinder no. 1 has reached top dead center and begins its suction or fluid intake stroke, if the pressure for that chamber does not drop immediately to pump inlet pressure within about 0° to 10° of crankshaft rotation, but indicates some delay in decreasing to essentially zero or nominal intake or suction manifold pressure, there is indicated to be a delay in closing of the discharge valve 42. For example, in FIG. 3, the display shows that discharge valve 42 is not closed for 16.7° of rotation after piston top dead center position. Accordingly, pressure changes, or the lack thereof, are sensed by the cylinder chamber pressure sensors 62, 64 and 66.

Software embedded in processor 46 is operable to correlate the angle of rotation of the crankshaft 24 with respect to pressure sensed in the respective cylinder chambers 32 to determine any delay in pressure changes which could be attributable to delays in the respective suction or discharge valves reaching their fully seated and sealed positions. These delays can, of course, affect volumetric efficiency of the respective cylinder chambers 32 and the overall volumetric efficiency of the pump 20. In this regard, total volumetric efficiency is determined by calculating the average volumetric efficiency based on the angular delay in chamber pressure increase or pressure decrease, as the case may be, with respect to the position of the pistons in the respective chambers.

The volumetric efficiency of the pump 20 is a combination of normal pump timed events and the sealing condition of the piston seal and the inlet and discharge valves. Pump volumetric efficiency and component status is determined by determining the condition of the components and calculating the degree of fluid bypass. Pump volumetric efficiency (VE) is computed by performing a computational fluid material balance around each pump chamber.

$$VE = \frac{AD}{TD} \times 100$$

where AD equals actual chamber displacement and TD equals theoretical chamber displacement wherein actual chamber displacement equals the chamber volume swept by the piston less inlet valve delayed seal volume, a direct timing event, discharge valve delayed seal volume, a direct timing event, fluid decompression volume, a direct timing event, inlet valve seal leakage volume, a differential computation, pressurizing seal leakage volume, a differential computation, and discharge valve seal leakage volume, a differential computation.

A differential computation is made by taking the difference in normal timed events and actual timed events and approximating equivalent rates of flow. Pulsation control equipment devices are velocity stabilizers. The actual timing events affect the velocity profile of the pump and result in a larger volume of fluid to be handled to maintain a given level of residual pressure variation as pump component delays increase with wear.

Pump chamber pressures, as sensed by the sensors 62, 64 and 66, may be used to determine pump timing events that affect performance, such as volumetric efficiency, and chamber maximum and minimum pressures, as well as fluid compression delays. Still further, fluid pressures in the pump chambers may be sensed during a discharge stroke to determine, through variations in pressure, whether or not there is leakage of a piston packing or seal, such as the packing 25, FIG. 2. Still further, maximum and minimum chamber fluid pressures may be used to determine fatigue limits for certain components of a pump, such as the fluid end housing 31, the valves 36 and 42 and virtually any component that is subject to cyclic stresses induced by changes in pressure in the pump chambers and the pump discharge piping.

As mentioned previously, the processor 46 is adapted with a suitable computer program to provide for determining pump volumetric efficiency which is the arithmetic average of the volumetric efficiency of the individual pump chambers as determined by the onset of pressure rise as a function of crankshaft position (delay in suction valve closing and seating) and the delay in pressure drop after a piston has reached top dead center (delay in discharge valve closing and seating).

The aforementioned computer program, which may include Microsoft XP Professional Operating System and a program known as Lab-View available from National Instruments, Inc., may be used to calculate pump fluid flow rate, which is computed by multiplying the determined pump volumetric efficiency by the total piston swept volume. Moreover, minimum net positive suction head ($NPSH_R$) pipe pressures may be computed by computing the suction pressure where a three percent drop in volumetric efficiency occurs. Still further, pump mechanical efficiency may be computed by calculating the hydraulic energy or fluid power delivered, based on the calculated rate of fluid flow and discharge pressure which is divided by power input to the pump as determined by the sensor 50 or a suitable sensor which measures output power of the aforementioned prime mover.

Figure 4:
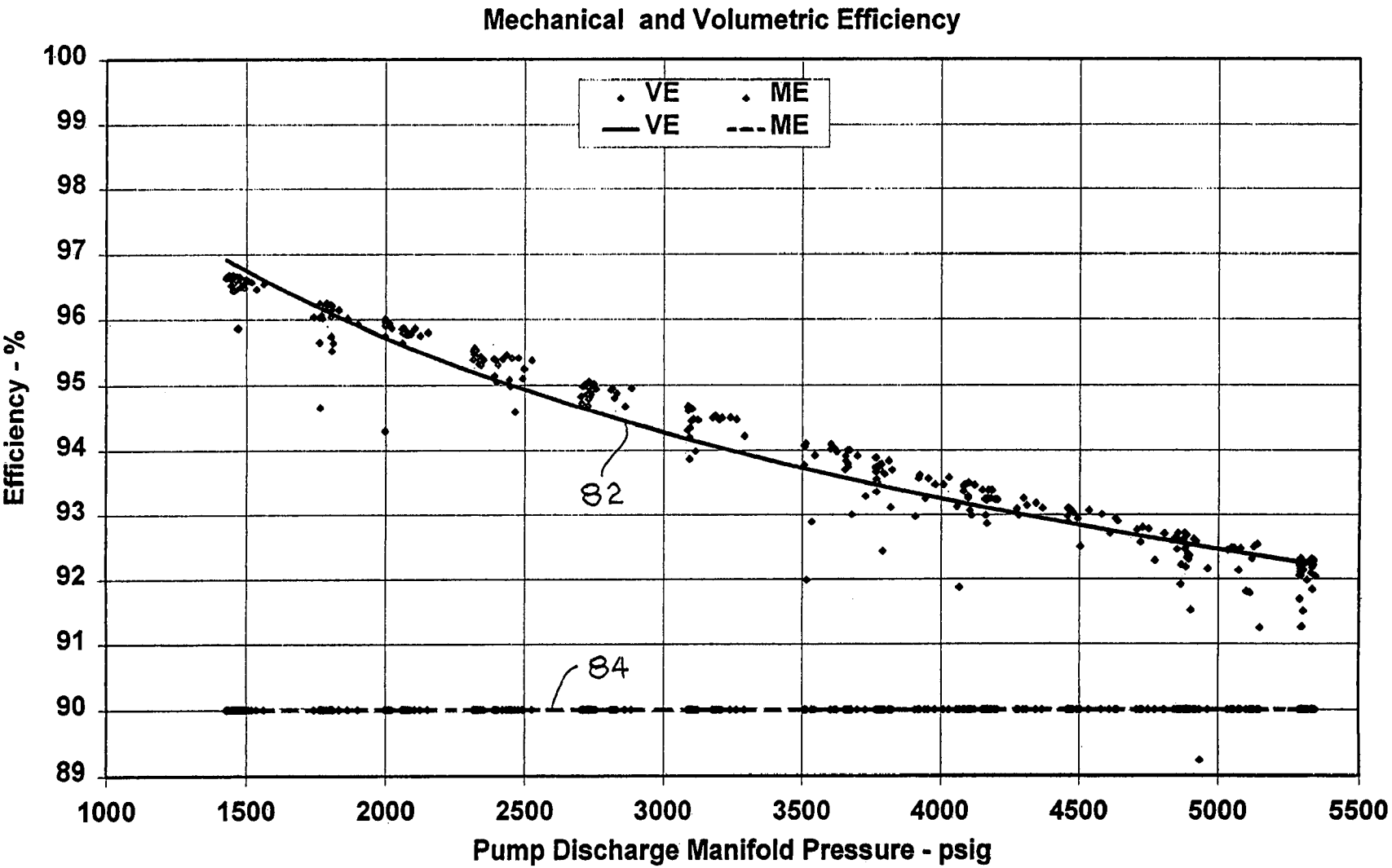
FIG. 4 is a graphic display provided by the system of the invention comprising a diagram of pump volumetric and mechanical efficiency versus pump discharge pressure.

Another diagram which may be displayed on monitor 80 or transmitted to another suitable display or monitor, not shown, is indicated by FIG. 4 where volumetric efficiency and mechanical efficiency are displayed as a function of pump discharge manifold pressure which may be sensed by sensor 68, FIG. 1, for example. A volumetric efficiency curve or line 82, FIG. 4, may be determined based on multiple plots of pump discharge pressure and the efficiencies calculated by the processor 46. Curve 84 represents pump mechanical efficiency based on the aforementioned method as a function of pump discharge manifold pressure.

Figure 5:
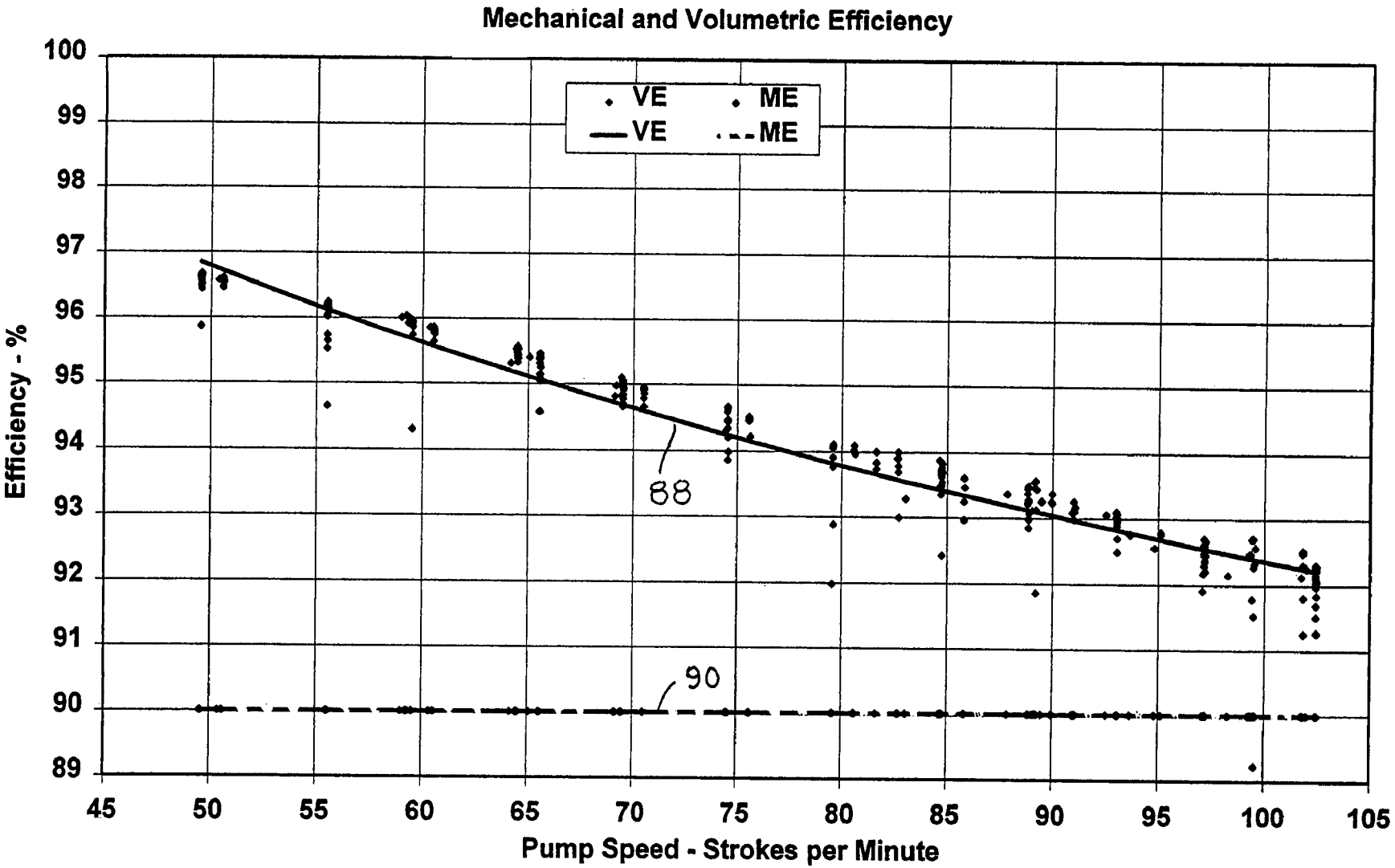
FIG. 5 is a graphic display provided by the system of the invention comprising a diagram showing mechanical and volumetric efficiency versus pump speed.

FIG. 5 illustrates a plot which may also be generated by processor 46. FIG. 5 illustrates pump volumetric efficiency, indicated by curve 88, and mechanical efficiency, indicated by curve 90, as a function of pump speed in piston or plunger strokes per minute.

Additional parameters which may be measured and calculated in accordance with the invention are the so-called delta volumes for the suction or inlet stabilizer 72 and the discharge pulsation dampener 74. The delta volume is the volume of fluid that must be stored and then returned to the fluid flowstream to make the pump suction and discharge fluid flow rate substantially constant. This volume varies as certain pump operating parameters change. A significant increase in delta volume occurs when timing delays are introduced in the opening and closing of the suction and discharge valves. The delta volume is determined by applying actual angular degrees of rotation of the crankshaft 24 with respect the suction and discharge valve closure delays to a mathematical model that integrates the difference between the actual fluid flow rate and the average flow rate.

Another parameter associated with determining component life for a pump, such as the pump 20, is pump hydraulic power output for each pump working cycle or 360° of rotation of the crankshaft 24. Still further, pump component life cycles may be determined by using a multiple regression analysis to determine parameters which can project the actual lives of pump components. The factors which affect life of pump components are absolute maximum pressure, average maximum pressure, maximum pressure variation and frequency, pump speed, fluid temperature, fluid lubricity and fluid abrasivity.

As mentioned previously, pressure variation during fluid "compression" is an indication of the condition of a piston or plunger packing seal. This variation is defined as an absolute maximum deviation of actual pressure data from a linear value representative of the compression pressure and is an indication of the condition of seals, such as seals 25. A leaking seal, such as seal or packing 25, FIG. 2, results in a longer compression cycle because part of the fluid being displaced is bypassing or leaking through the seal. A pump chamber "decompression" cycle is also shorter because, after the discharge valve completely closes and seals against its seat, part of the fluid to be decompressed is bypassing a plunger seal or packing. The difference in volume required to reach discharge operating pressure over a "compression" cycle for each pump chamber determines an average leakage rate. This leakage rate is adjusted for a leak rate at discharge operating pressures by calculating a leak velocity based on standard orifice plate pressure drop calculations.

Suction valve leak rate results in a longer decompression cycle because part of the fluid being displaced by the pressurizing element is returning to the pump inlet or suction fluid flowline. The difference in volume required to reach discharge operating pressure over a compression cycle determines an average leakage rate. This compression leak rate is then adjusted for a leak rate at discharge operating pressures by calculating a leak velocity based on standard orifice plate pressure drop calculations. The leak rate is then applied to the duration of the discharge valve open cycle.

So-called pump intake or suction acceleration head response is an indicator of the suction piping configuration and operating conditions which meet the pump's demand for fluid. This is defined as the elapsed time between the suction valve opening and the first chamber or suction piping or manifold pressure peak following the opening.

Still further, the system of the present invention is operable to determine fluid cavitation which usually results in high pressure "spikes" occurring in the pumping chamber during the suction stroke. Generally, the highest pressure spikes occur at the first pressure spike following the opening of a suction valve, such as the valve 36. Both minimum and maximum pressures are monitored to determine the extent and partial cause of cavitation.

The system 44 is also operable to provide signals indicating valve design and operating conditions which can result in excessive peak pressures in the pumping chambers before the discharge valve opens, for example. These peaks or so-called overshoot pressures can result in premature pump component failure and excessive hydraulic forces in the discharge piping. For purposes of such analysis, the overshoot pressure is defined as peak chamber pressure minus the average discharge fluid pressure.

The system 44 of the present invention is also operable to analyze operating conditions in the pump suction and discharge flow lines, such as the piping 34 and 40, respectively. A normally operating multiplex power pump will induce pressure variations at both one and two times the crankshaft speed multiplied by the number of pump pistons. Flow induced pressure variation is defined as the sum of the peak-to-peak pressure resulting from these two frequencies. Also, acceleration induced pressure spikes are created when the pump valves open and close. Acceleration pressure variation for purposes of the methodology of the invention is defined as the total peak-to-peak pressure variation.

Hydraulic resonance occurs when a piping system has a hydraulic resonant frequency that is excited by forces induced by operation of a pump. Fluid hydraulic resonance is determined by analysis of the pressure waves created by the pump to determine how close the pressure response matches a true sine wave.

The system of the invention is also operable to analyze pulsation control equipment operation. For example, pulsation control equipment or so-called pulsation dampeners are subject to failure along with many other components of a pump system. Loss of the dampener pneumatic charge can result in a significant increase in fluid flow induced pressure variations. The system 44 of the invention is operable to sound an alarm when the flow induced pressure variation exceeds a predetermined limit.

Figure 6:
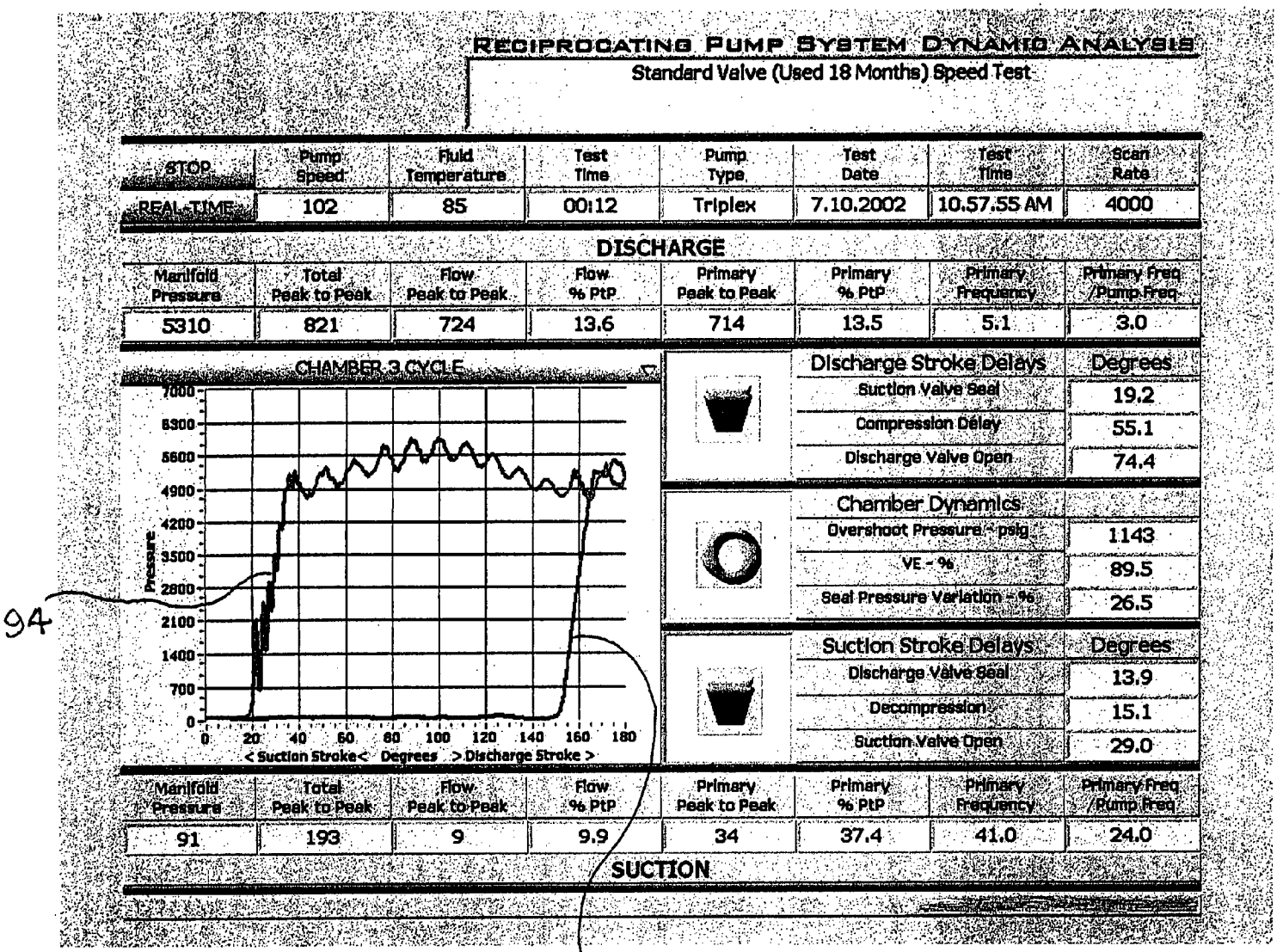
FIG. 6 is a graphic display showing pump suction and discharge pressures versus piston position and also showing valve and seal operating characteristics.

Those skilled in the art will appreciate that the system 44, including pressure sensors 58, 60, 62, 64, 66, 68 and 70, together with the sensor 54 provides information which may be used to analyze a substantial number of system operating conditions for a pump, such as the pump 20. Referring to FIG. 6, for example, the processor 46 is adapted to provide a visual display which may be displayed on the monitor 80, for example, providing the information shown on the drawing figure. The graphical display of pressure versus crankshaft position for each cylinder chamber may be selectively provided.

FIG. 6 illustrates a graph of chamber no. 3 for the pump 20 showing discharge pressure, as sensed by the sensor 66, and indicated by the curve 94. As the crankshaft 24 drives the piston 22 associated with cylinder chamber no. 3 on its discharge stroke, there is a delay of approximately 19° to 20° in crankshaft rotation before pressure increases, which is manifested as a suction valve seal malfunction, as indicated on the display of FIG. 6 under the heading "Discharge Stroke Delays" to the right of the graph of pressure versus crankshaft rotation angle. Moreover, for a design discharge pressure of 5000 psig, curve 94 also indicates that a maximum overshoot pressure of 1143 psi is experienced during a piston discharge stroke. Pressure fluctuations between crankshaft angles of about 20° and 40° also indicates possible seal leakage, such as from a seal 25, as exhibited by pressure variations of curve 94.

Referring further to FIG. 6, there is illustrated a display operable to be generated by processor 46. The graph of the display shown in FIG. 6 includes a second curve 96 showing pump chamber pressure for chamber no. 3 versus crankshaft position as the piston 22 for cylinder no. 3 moves from its top dead center position to its bottom dead center position. As noted from curve 96, there is a delay of about 14° of crankshaft rotation before pressure decreases, indicating discharge valve sealing delay, decompression of the fluid and relaxation of any elastic deformation of the fluid end housing 31 or associated cover members, such as the cover members 33*a* and 33*b*, FIG. 2. FIG. 6 further illustrates the amount of rotation of the crankshaft 24 before the suction valve opens at 29° of rotation from piston top dead center.

The graphic display of FIG. 6 also shows the discharge pressure parameters including discharge manifold pressure, total peak-to-peak pressure, flow induced peak-to-peak pressure, flow induced peak-to-peak pressure as a percent of average manifold pressure, the primary (largest) peak-to-peak pressure which is occurring at a particular frequency, the primary peak-to-peak pressure as a percent of average manifold pressure, the frequency in Hertz of the primary peak-to-peak pressure and the primary frequency divided by pump rotational frequency. The same parameters are shown for suction manifold pressure in the display of FIG. 6.

Figure 7:
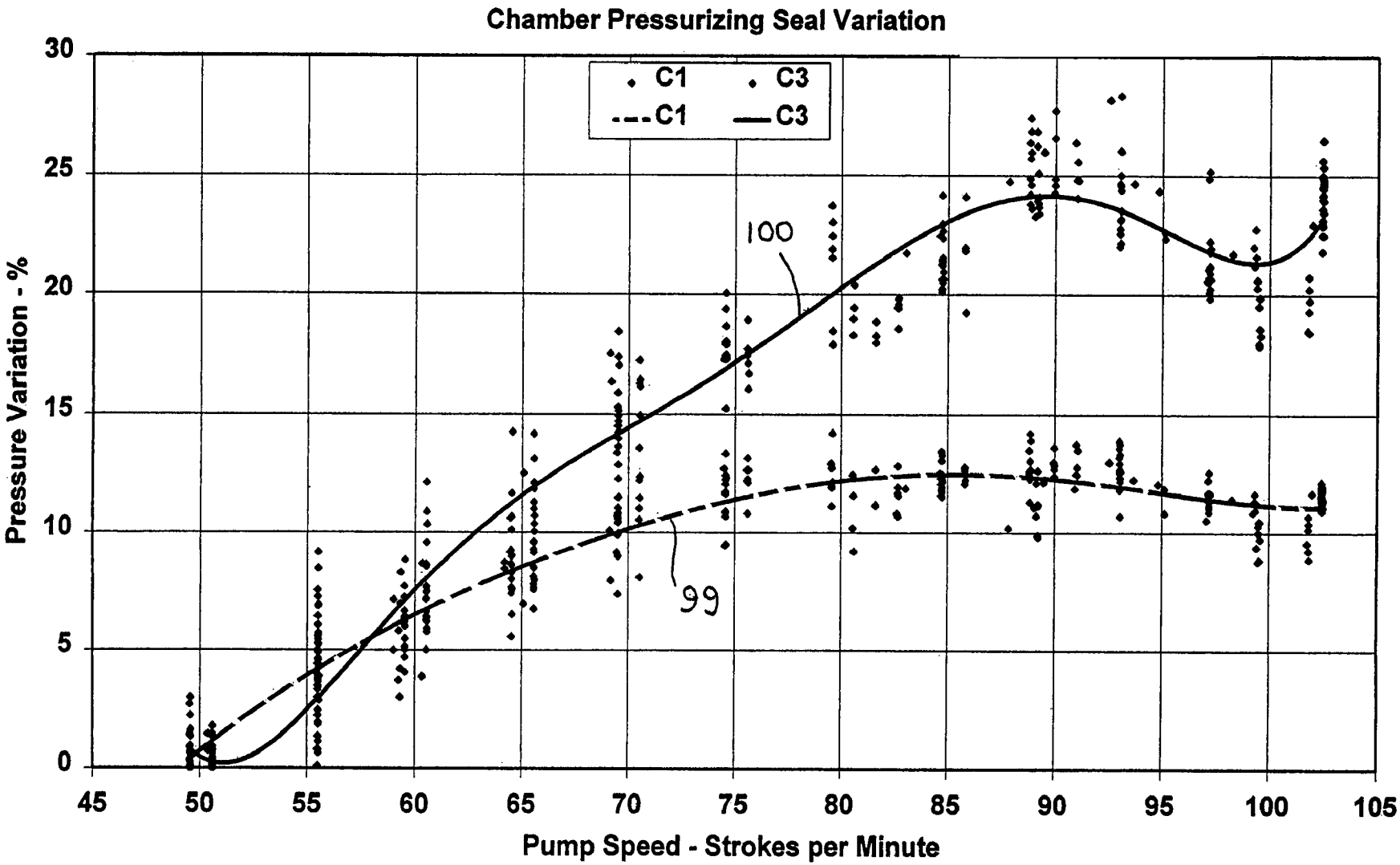
FIG. 7 is a graphic display provided by the system of the invention comprising a diagram of pump chamber pressure variations during the compression cycle, an indication of the condition of the seal, versus pump speed.

Referring briefly to FIG. 7, there is illustrated a diagram operable to be generated by processor 46 showing pressure variation versus pump speed as determined by the system 44 based on measuring chamber pressure and crankshaft position and speed. Chamber pressures for cylinder no. 1 are indicated by curve 99 and chamber pressure variation for cylinder no. 3 are indicated curve 100 in FIG. 7.

Figure 8:
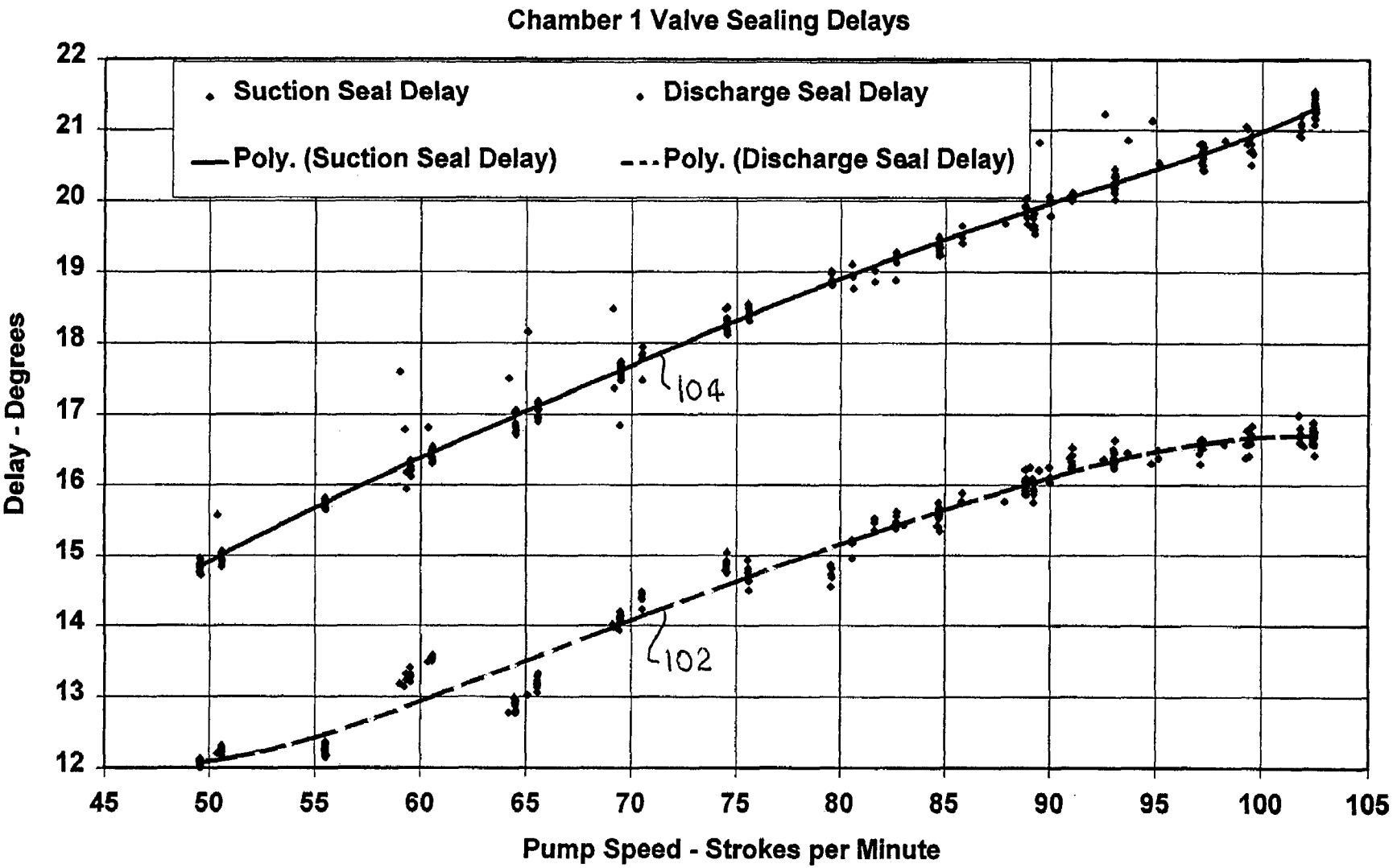
FIG. 8 is graphic display provided by the system of the invention comprising a diagram showing typical valve sealing delay versus pump speed.

FIG. 8 illustrates a display operable to be generated by processor 46 showing crankshaft angle versus pump speed in strokes per minute wherein curve 102 represents discharge valve sealing delays in degrees of crankshaft rotation from piston top dead center. Suction valve sealing delays, from piston bottom dead center, are indicated by curve 104.

Figure 9:
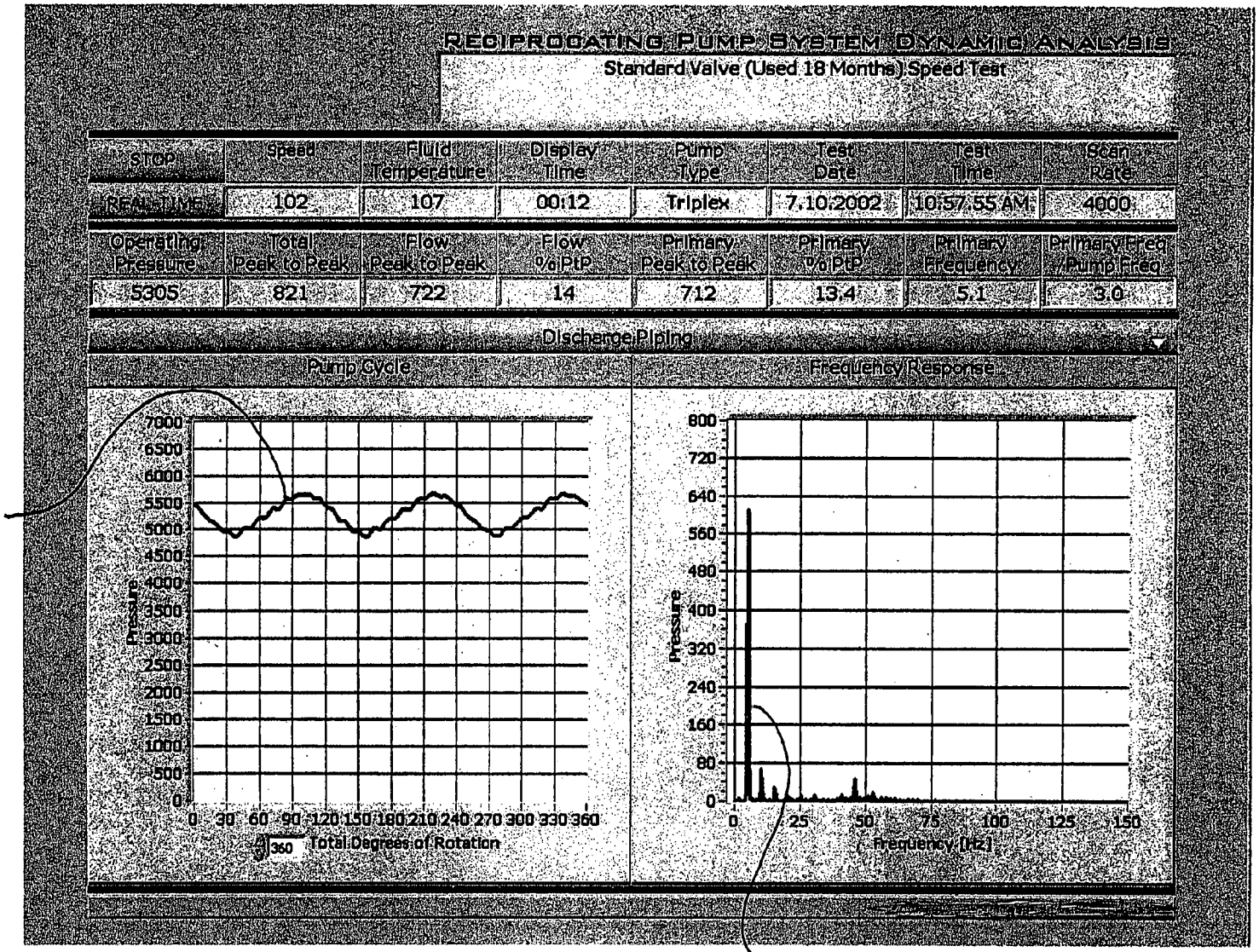
FIG. 9 is a graphic display of pump pressure, frequency response and selected data produced by the system of the invention.

The system 44 of the invention is also adapted to provide the graphic displays of FIGS. 9 through 14. Referring to FIG. 9, for example, there is illustrated a diagram of pump discharge pressure versus crankshaft angle showing the variation in pump discharge piping pressure, as indicated by curve 106, as well as the frequency and amplitude of pressure pulsations, as indicated by the curve 108. Additional pump operating parameters are also indicated in the diagram of FIG. 9.

Figure 10:
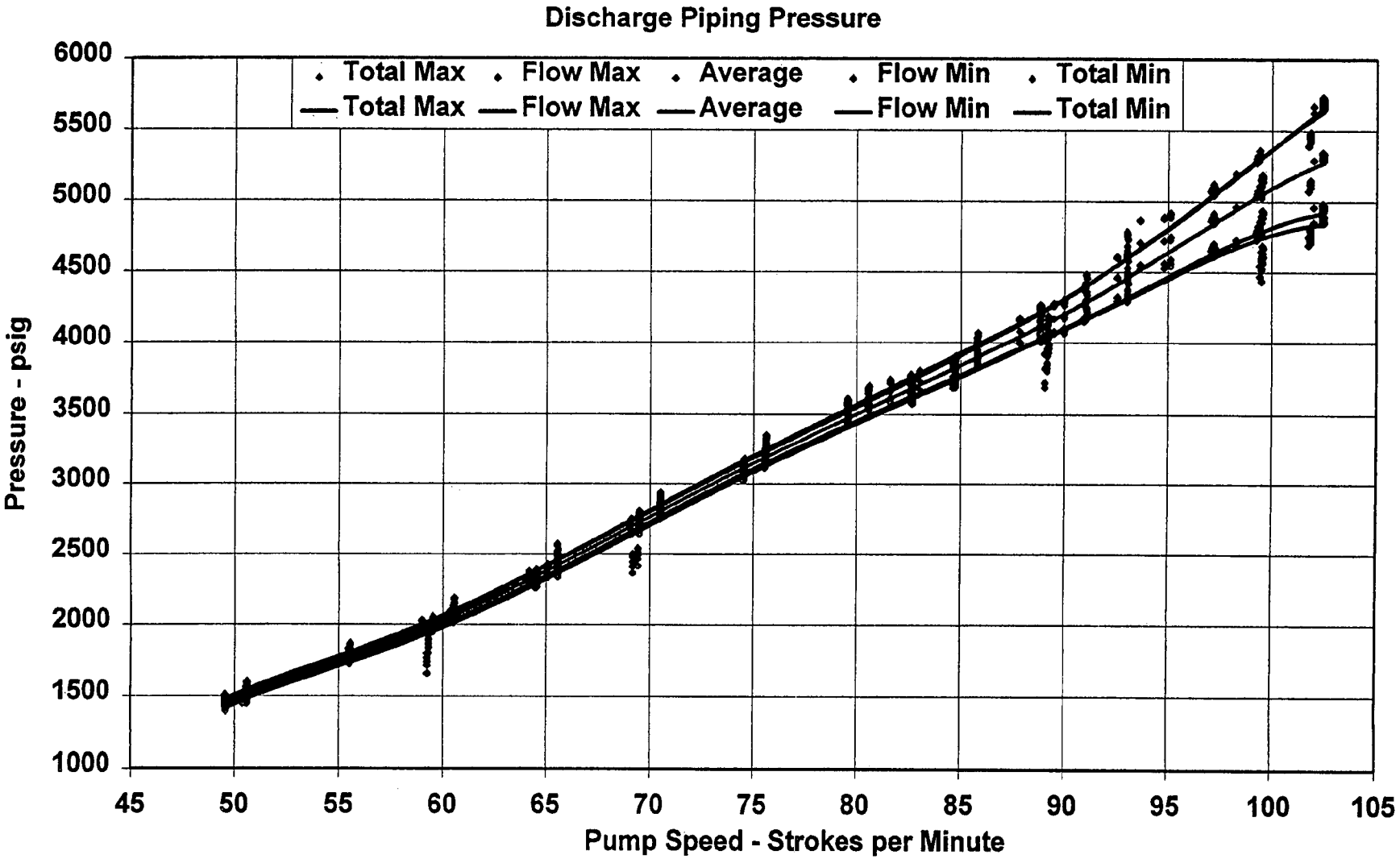
FIG. 10 is a graphic display provided by the system of the invention comprising a diagram illustrating discharge (or suction) piping (or pump manifold) flow, acceleration induced, cavitation, and hydraulic resonance pressure variation versus pump speed.
Figure 11:
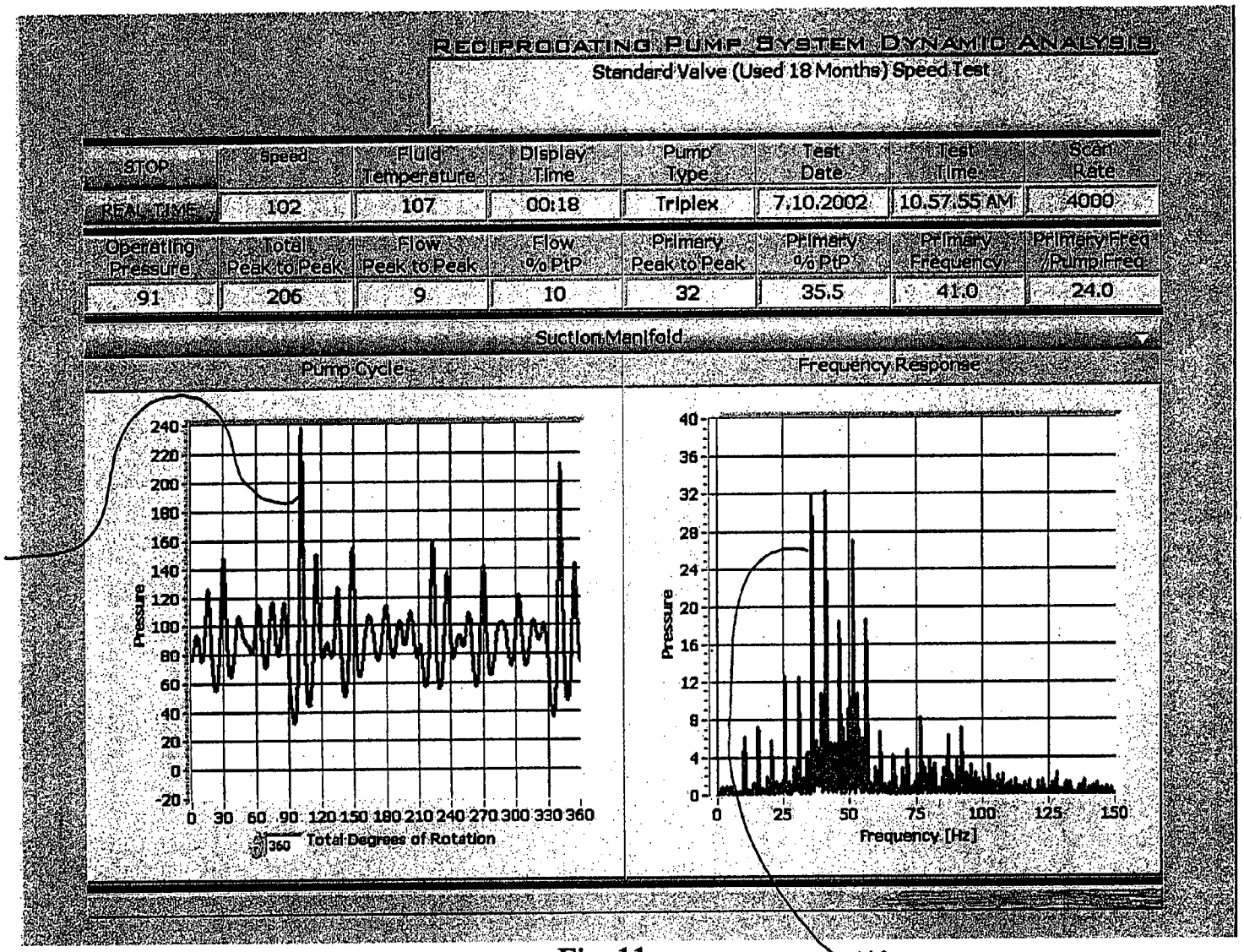
FIG. 11 is a graphic display showing pressure as a function of pump crank position and frequency response at the pump suction (or discharge) manifold (or piping) and provided by the system of the invention.
Figure 12:
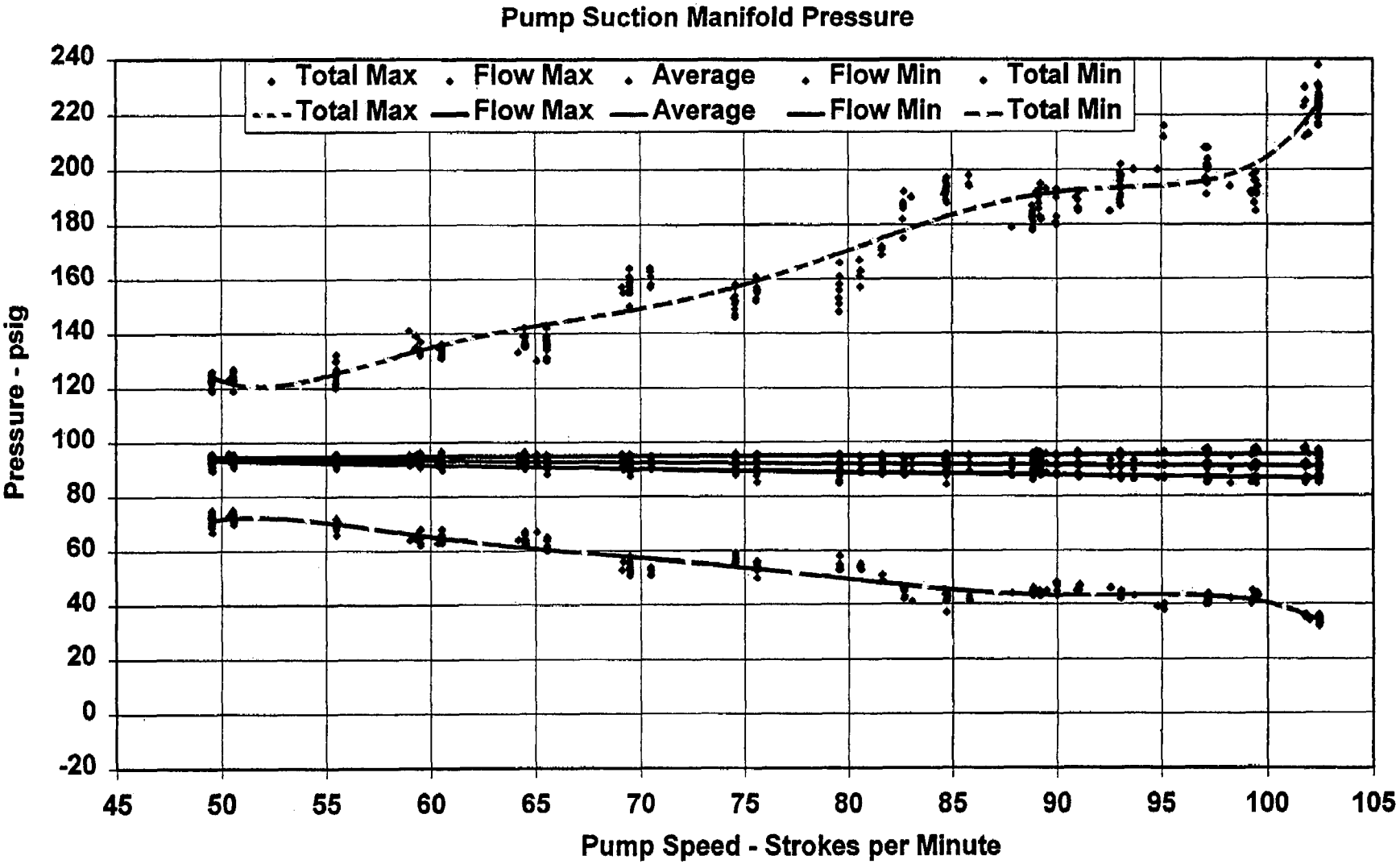
FIG. 12 is a graphic display provided by the system of the invention comprising a diagram showing pump suction manifold pressure versus speed.

Another display which may be provided by the system 44 is shown in FIG. 10 which comprises a diagram of pump discharge piping pressure as measured by pressure sensor 70 versus pump speed in piston strokes per minute as calculated by the system 44. Still further, as shown in FIG. 11, the system 44 is operable to display fluid pressure conditions in the pump suction manifold, such as the manifold or piping 34. The graph of fluid pressure versus crankshaft angle shows a curve 110 indicating the variation in suction manifold fluid pressure. The graph of suction pressure variation versus frequency is indicated by a curve 112. FIG. 12 is a diagram which may also be generated and displayed by the processor 46 and the monitor 80, of suction manifold pressure variation versus pump speed, as indicated.

As will be appreciated from the foregoing description, valve performance for reciprocating piston power pumps is an important consideration. The diagram in accordance with FIG. 8 comprises a valve timing chart which displays the crankshaft rotation angle past the mechanical ends of the piston stroke where the suction and discharge valves seal, respectively, as a function of pump speed. The diagram of FIG. 8 indicates that valve sealing delay is varied within a range of at least 2° at a given speed and is increasing by 5° or more as pump speed is increased from 50 to 102 strokes per minute. A sealing delay of less than 10°, instead of the 12° to 21° observed, is desirable.

With respect to the information provided according to FIGS. 9 and 10, it will be appreciated that the amplitude of pressure variations in the frequency response diagrams indicate that hydraulic resonance is occurring in the discharge piping at a pump speed of 102 strokes per minute. Still further, with regard to the diagrams of FIGS. 11 and 12, as shown by way of example, acceleration pressure head loss is occurring in the pump suction manifold at a maximum speed of 102 strokes per minute, as indicated by the difference between the maximum and minimum pressures at maximum speed.

A typical installation of a system 44 for temporary or permanent performance monitoring and/or analysis requires that all of the pressure transducers be preferably on the horizontal center line of the pump piping or pump chambers, respectively, to minimize gas and sediment entrapment.

The system of the invention is also operable to determine pump piping hydraulic resonance and mechanical frequencies excited by one or more pumps connected thereto for both fixed and variable speed pumps. Preferably, a test procedure would involve instrumenting the pump, where plural pumps are used, that is furthest from the system discharge flowline or manifold. A vibration sensor, such as the sensor 56, should be located at the position of the most noticeable piping vibration. The piping system should be configured for the desired flow path and all block valves to pumps not being operated should be open as though they were going to be operating. The instrumented pump or pumps should be started and run at maximum speed for fifteen minutes to allow stabilization of the system. The data acquisition system 44 should then be operated to collect one minute of pumping system data. Alternatively, data may be continued to be collected while changing pump speed at increments of five strokes per minute every thirty seconds until minimum operating speed is reached. Data may be continued to be collected while changing suction or discharge pressures. The displays provided by the processor 46 should be reviewed for pump operating problems as well as hydraulic and mechanical resonance. If a hydraulic resonant condition is observed, this may require the installation of wave blockers or orifice plates in the system piping.

Figure 13:
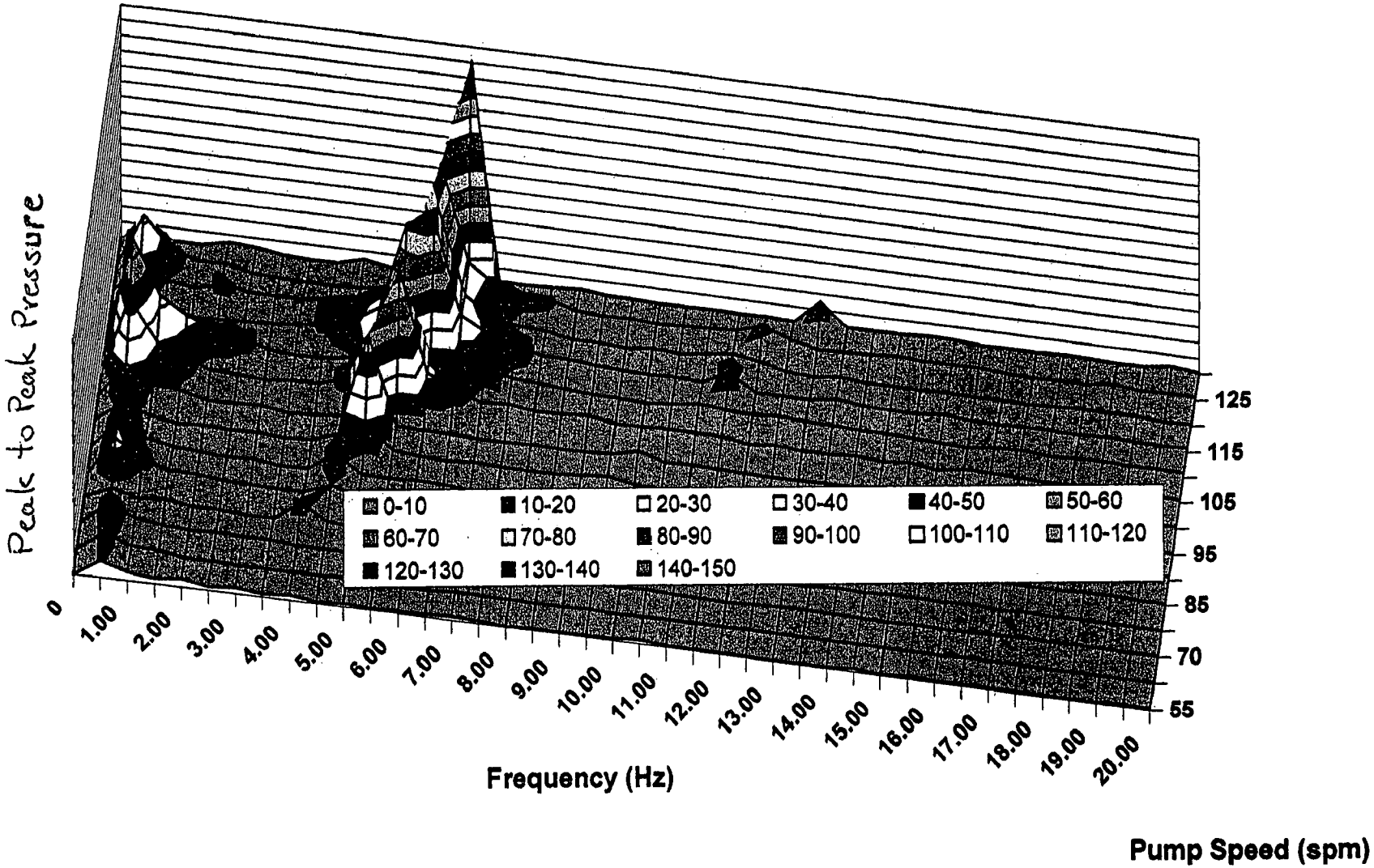
FIG. 13 is a graphic display provided by the system of the invention comprising a three dimensional diagram of pump speed versus peak pressures for various pressure pulsation frequencies.
Figure 14:
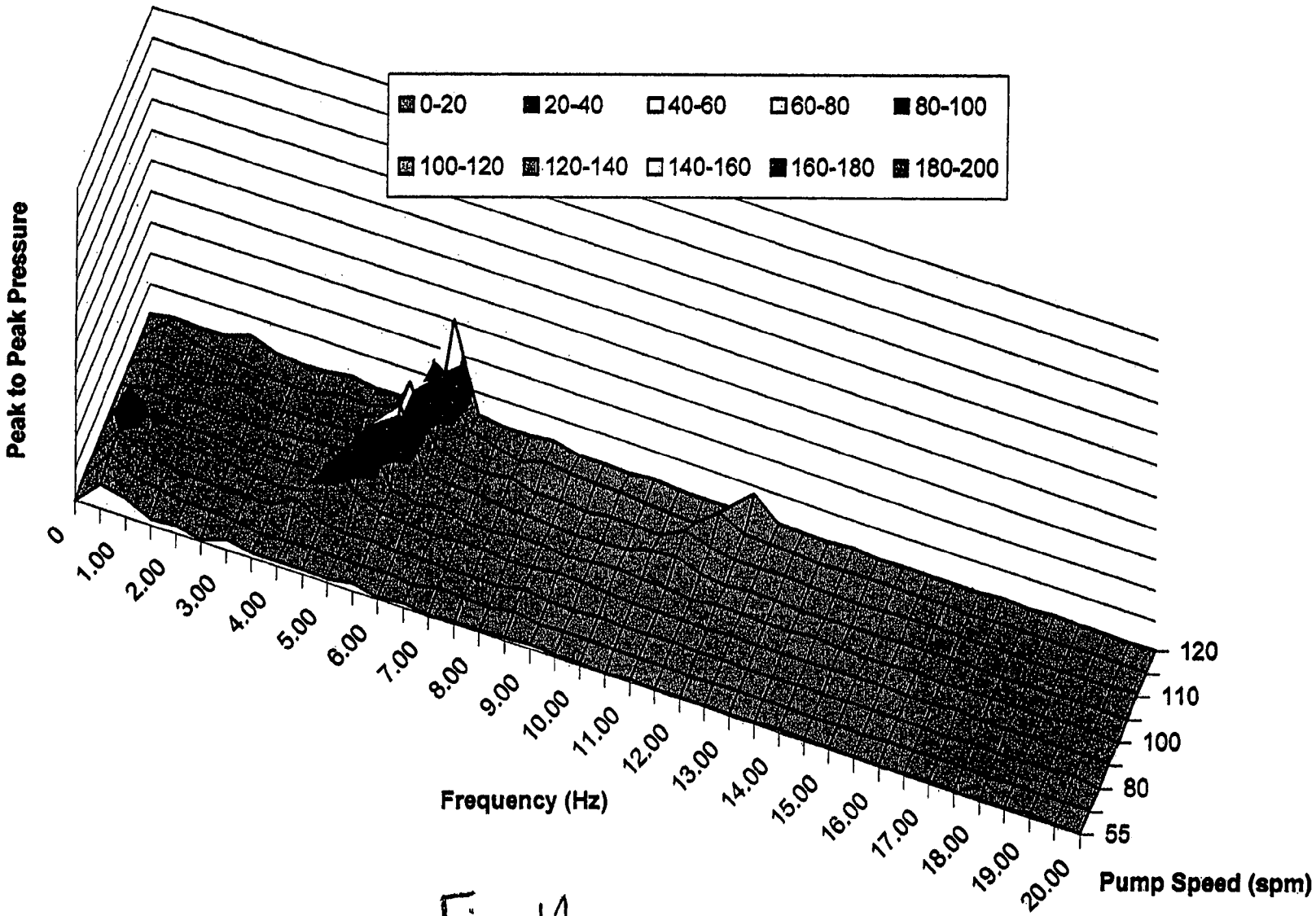
FIG. 14 is a graphic display provided by the system of the invention comprising another diagram of pump speed versus peak pressures.

The system 44 is operable to provide displays comprising simulated three dimensional charts, as shown in FIGS. 13 and 14, displaying peak-to-peak pressures occurring at respective frequencies for a given pump speed in strokes per minute. For a triplex pump, the normal excitation frequency is three and six times the pump speed. As pump speed increases, the excitation frequencies increase. Without orifice plates or so-called wave blockers, hydraulic resonance was observed at seven Hertz at 130 strokes per minute for the exemplary system of FIG. 13. After installation of orifice plates or wave blockers, the peak-to-peak pressure was significantly reduced as indicated by FIG. 14. The pump system in question, in fact, experienced normal levels of peak-to-peak pressure variation, as indicated in FIG. 14.

Those skilled in the art will recognize that the system and methods of the present invention provide a convenient and substantially complete system and process for determining performance parameters of hydraulic power pumps, and may be used on a temporary basis for diagnostic work and on a permanent installation basis for monitoring pump operation. The displays of FIGS. 3 through 14 are novel but other forms of display may be used within the scope of the invention, including but not limited to tabular forms of presenting data, for example. Still further, the displays may be presented in other forms, such as via a printer substituted for or in addition to the monitor 80. Although preferred embodiments of a system and methods are described and shown, those skilled in the art will further appreciate that various substitutions and modifications may be made without departing from the scope and spirit of the appended claims.

What is claimed is:

1. A method for determining selected performance parameters of a reciprocating piston power pump, said pump including a housing providing at least one fluid chamber therein, a fluid inlet valve opening into said chamber, a fluid discharge valve for discharging fluid from said chamber, a reciprocating piston operable to displace fluid from said chamber, inlet and discharge fluid piping in fluid flow communication with said chamber, at least one pressure sensor in communication with said chamber for measuring pressure therein, at least one position sensor for sensing piston position with respect to said chamber, and a signal processor operably connected to said sensors for receiving signals from said sensors, respectively, and for determining selected performance parameters, said method comprising the steps of:

sensing pressure variations in said chamber, determining selected positions of said piston with respect to said chamber, and determining at least one pump performance parameter based on sensed pressure and piston position and selected from a group consisting of valve sealing delay, piston seal leakage, pressures in said chamber, volumetric efficiency, pump fluid flow rate, hydraulic power produced for a pump operating cycle, and a pump pulsation dampener volume factor of said pump; and causing at least one of recording and displaying said selected performance parameter.

2. The method set forth in claim 1 including the step of:

displaying at least one of operating pressure, peak-to-peak pressure and fluid flow induced peak-to-peak pressure in at least one of fluid discharge piping and fluid inlet piping connected to said pump.

3. The method set forth in claim 1 including the step of:

displaying the delay in sealing of at least one of said inlet valve and said discharge valve as a function of piston position.

4. The method set forth in claim 1 including the step of:

displaying piston seal leakage as a function of fluid discharge pressure variation during a discharge stroke of said piston.

5. The method set forth in claim 1 including the step of:

displaying one of pump volumetric efficiency and mechanical efficiency as a function of pump discharge pressure.

6. The method set forth in claim 1 including the step of:

displaying at least one of pump volumetric efficiency and mechanical efficiency as a function of pump speed.

7. The method set forth in claim 1 including the step of:

displaying pump chamber pressure as a function piston position with respect to said chamber to determine pressure variation during displacement of fluid from said chamber, delay in chamber pressure increase during a piston fluid discharge stroke and delay in chamber pressure decrease during a piston fluid inlet stroke.

8. The method set forth in claim 1 including the step of:

displaying chamber pressure variation as a function of pump speed during a discharge stroke of said piston.

9. The method set forth in claim 1 including the step of:

displaying delay in fluid inlet and discharge valve closure with respect to piston position at selected pump speeds.

10. The method set forth in claim 1 including the step of:

displaying at least one of pump discharge pressure as a function of piston position and pressure variation at selected frequencies thereof.

11. The method set forth in claim 1 including the step of:

displaying peak pressures as a function of frequency of said peak pressures for selected speed of movement of said piston in strokes per minute.

* * * * *

UNITED STATES PATENT AND TRADEMARK OFFICE

CERTIFICATE OF CORRECTION

PATENT NO. : 7,623,986 B2
APPLICATION NO. : 11/105709
DATED : November 24, 2009
INVENTOR(S) : J. Davis Miller It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 793 days.

Signed and Sealed this

Twenty-sixth Day of October, 2010

David J. Kappos

David J. Kappos
*Director of the United States Patent and Trademark Office*